United States Patent [19]

Nelson

[11] Patent Number: 4,594,580

[45] Date of Patent: Jun. 10, 1986

[54] EXPANDED-CAPACITY WIRELESS SECURITY SYSTEM WITH DUAL-RANGE ENVIRONMENTAL MONITORING AND CONTROL

[75] Inventor: Jack Nelson, East Brunswick, N.J.

[73] Assignee: Wems/International Controls, Inc., Cherry Hill, N.J.

[21] Appl. No.: 680,628

[22] Filed: Dec. 12, 1984

[51] Int. Cl.[4] ..... G08B 19/00

[52] U.S. Cl. ..... 340/521; 340/501; 340/507; 340/539; 340/696; 340/522; 374/133; 236/91 C

[58] Field of Search ..... 340/521, 522, 500, 501, 340/506–510, 531, 539, 533, 584, 588, 589, 696, 825.69, 825.72, 870.16, 870.17; 374/110, 132, 133, 141; 236/91 C, 91 F, 94, DIG. 2

[56] References Cited

U.S. PATENT DOCUMENTS

| | | | |
|---|---|---|---|
| 4,321,592 | 3/1982 | Crandall et al. | 340/521 |
| 4,360,801 | 11/1982 | Duhame | 340/521 |
| 4,415,884 | 11/1983 | Delin et al. | 340/507 |

OTHER PUBLICATIONS

A portion of Capricorn Electronics Incorporated price list for "Professional Wireless Security Systems", dated Sep. 1, 1983.

*Primary Examiner*—Donnie L. Crosland

*Attorney, Agent, or Firm*—Seidel, Gonda, Goldhammer & Abbott

[57] ABSTRACT

A multiple-RF channel wireless security system has expanded monitoring and control capacity without a concomitant increase in the number of available RF channels. At least one primary condition-responsive monitoring and RF signaling device having a first range of values for the parameter being monitored has an associated secondary condition-responsive monitoring device having a second range of values for the same parameter connected in series with the primary device. The secondary device may operate in conjunction with or independently of the primary device. When operating in conjunction with the primary device, the secondary device supplements the primary device by providing a second range of parameter values, and may, for example, provide back-up or "fail safe" operation of the primary device. When operating independently of the primary device, the secondary device provides expanded monitoring and control capabilities of the security system while preserving the number of RF channels.

6 Claims, 3 Drawing Figures

EXPANDED-CAPACITY WIRELESS SECURITY SYSTEM WITH DUAL-RANGE ENVIRONMENTAL MONITORING AND CONTROL

BACKGROUND OF THE INVENTION

RF wireless remote security systems have one or more radio frequency (RF) channels to receive signals from remote sensors, each of which is equipped with an RF transmitter. The remote sensors may be such things as glass break detectors (for burglary protection), smoke detectors (for fire detection) and passive infrared motion detectors (for burglary protection). Each sensor uses a discrete RF channel to communicate with the central processing unit (CPU) of the security system. When the remote condition-responsive sensor is triggered, it transmits an RF pulse over its associated RF channel to the CPU. A receiver in the CPU detects the RF pulse and, depending on the channel, may initiate one or more control functions. For example, the CPU may activate a burglar alarm or fire alarm either locally or at a central station. In addition, for burglary protection, the CPU may turn on premises lighting. The CPU may also activate a pre-programmed automatic telephone dialer for dialing a police or fire department, or any other telephone number.

More sophisticated wireless security systems are also arranged to respond to medical emergencies. The CPU may be arranged to accept an RF signal from a bedside transmitter or a transmitter worn around the neck of a patient. When the patient signals a medical emergency by activating his transmitter, the CPU may activate lights, a remote alarm or an automatic telephone dialer.

The CPU can also be used to remotely control premises lighting over existing AC line wiring. For example, by using a wireless hand held remote control transmitter, an RF pulse can be sent to the CPU from virtually anywhere in the premises to turn on lights by remote control. In this case, the CPU sends a control signal over the AC line wiring to a receiver with a switch to control the lighting. The switch is activated in response to the signal sent over the AC line wiring from the CPU.

Typical security systems, however, do not provide for control of premises heating, ventilating and air-conditioning (HVAC) equipment. Heretofore, premises HVAC have been controlled by closed systems separate from any premises security system. It would be advantageous to the users of the security system to include the HVAC control with the premises security system. Accordingly, there is a need for a premises security system which provides not only burglary and fire protection, but environmental control of the premises as well.

It would also be advantageous to provide back-up or "fail safe" operation of the remote sensors. The present invention achieves these advantages in a novel and unobvious manner and without appreciably increasing the complexity or cost of the wireless security system, and without requiring an increase in channel capacity.

SUMMARY OF THE INVENTION

The present invention is a wireless security system with a central processing unit and at least one primary condition-responsive monitoring device for wireless communication with the central processing unit. The primary condition-responsive monitoring device is arranged to monitor and respond to a parameter representative of a condition being monitored over a first range of values of the parameter. The primary condition-responsive monitoring device communicates with the central processing unit when the parameter falls outside the first range. The security system of the present invention has at least one secondary condition-responsive monitoring device for wired communication with the central processing unit. The secondary condition-responsive monitoring device is arranged to be selectively switched into and out of electrical series connection with the primary condition-responsive monitoring device. The secondary condition-responsive monitoring device monitors and responds to the same parameter representative of the condition being monitored over a second range of values of the parameter and communicates with the central processing unit when the parameter falls outside the second range. The second range of values is greater than or equal to the first range of values. Switch means are provided for selectively switching the secondary condition-responsive monitoring device into and out of electrical series connection with the primary condition-responsive monitoring device.

In a preferred embodiment of the invention, both the primary and secondary condition-responsive monitoring devices respond to ambient temperature, although the invention is not limited to temperature sensing and control.

DESCRIPTION OF DRAWINGS

For the purpose of illustrating the invention, there is shown in the drawings a form which is presently preferred, it being understood, however, that this invention is not limited to the precise arrangements and instrumentalities shown.

DESCRIPTION OF THE PREFERRED EMBODIMENT

Figure 1:
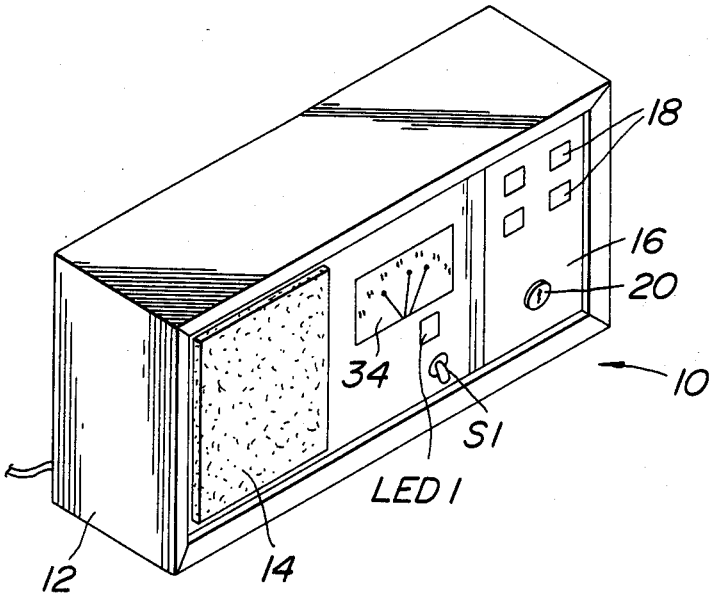
FIG. 1 is a perspective view of the central processing unit of the wireless security system in accordance with the present invention.

Referring now to the drawings, wherein like numerals indicate like elements, there is shown in FIG. 1 a central control unit 10 of the wireless security system of the present invention. The central control unit 10 comprises a housing 12 which contains operating and control circuitry, a speaker enclosure 14 which may house a local alarm, and a control panel 16. Control panel 16 includes a plurality of indicator lights 18 and a mode selector switch 20 for arming the wireless securing system and selecting the operating mode. The indicator lights 18 serve to indicate the operating mode selected by means of arming switch 20. Control panel 16 may also include a "defeat" switch S1, described in greater detail hereinafter.

Figure 2:
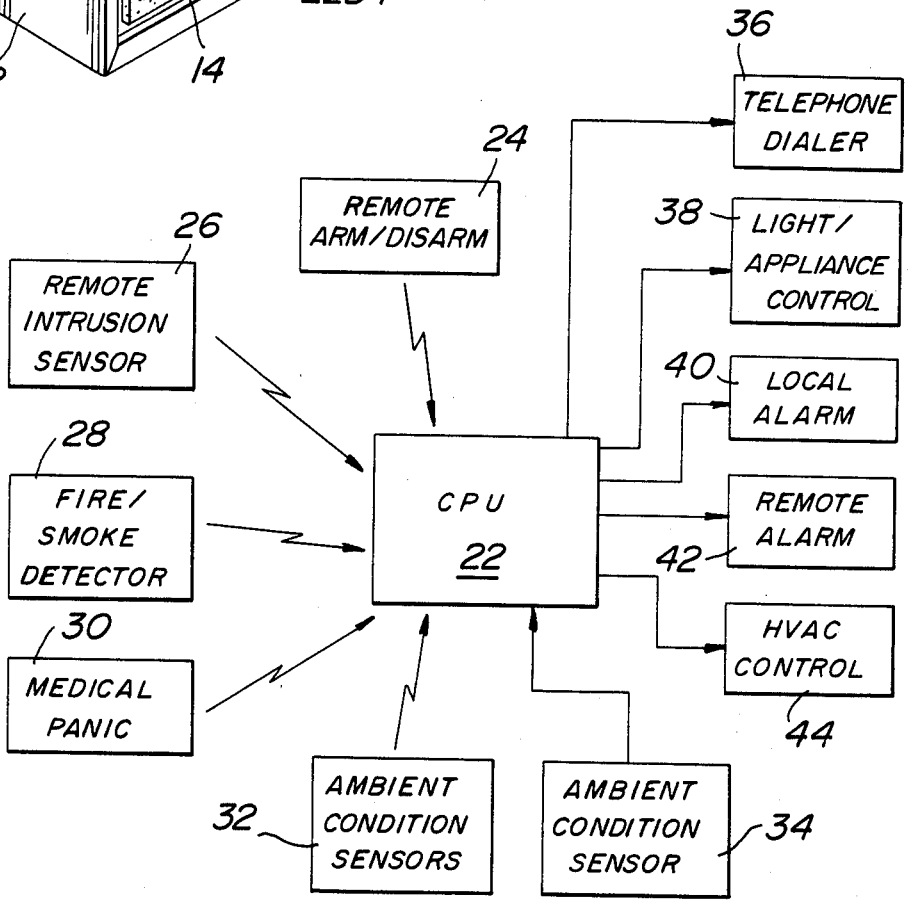
FIG. 2 is a simplified blocked diagram of the wireless security system of the present invention.

The relationship between the central control unit 10 and the remote sensors and controllers of the wireless security system is best understood by reference to FIG. 2. The central control unit circuity is illustrated for the sake of simplicity as central processing unit (CPU) 22 in FIG. 2. CPU 22 may be a microprocessor. CPU 22 has associated with it a plurality of RF channels and receivers by means of which CPU 22 can receive RF signals from remote sensors and monitors. As schematically illustrated in FIG. 2, the wireless security system of the present invention may include an RF channel for remote arming and disarming of the security system (block 24), and may include such monitors and sensors as an intrusion sensor 26, fire and/or smoke detector 28, medical emergency or "panic" sensor 30, and ambient condition sensors 32. Any number of RF channels and any number and combination of remote sensors may be employed as required. Such sensors are well known and understood in the art, and need not be described in great detail. It is sufficient to note that each sensor has associated with it an RF transmitter which transmits an RF burst of a predetermined frequency when the sensor is triggered. The frequency of the RF burst transmitted by each sensor may be individually preselected to correspond to one of the RF channels of the CPU 22.

CPU 22 also has at least one ambient condition sensor 34 directly wired to CPU 22.

In response to RF signals from one or more of the remote wireless sensors, CPU 22 may initiate a number of control functions. For example, as illustrated in FIG. 2, CPU may activate telephone dialer 36 to dial a preselected telephone number, turn on lights or appliances by means of light/appliance control 38, sound a local alarm 40 or a remote alarm 42, and send control signals to the premises HVAC system. As with the monitors and sensors, any number of different control functions may be carried out by the CPU. The manner in which the CPU generates the control signals, and the various instrumentalities for implementing the control signals are well known and understood in the art and need not be described here in detail. What is important, however, is that the wireless security system of the present invention includes a primary remote wireless ambient condition sensor 32 and a secondary wired-in ambient condition sensor 34, and generates an HVAC control signal for HVAC control 44.

Although the present invention is illustrated in the context of ambient condition sensing and HVAC control, it should be understood that any other condition sensor and any other control function may be used without departing from the scope of the invention.

Reference has been made earlier to the operating modes of the central processing unit 10. The security system of the invention has three operating modes: "HOME", "AWAY" and "IDLE". For purposes of this disclosure, the "IDLE" mode may be considered essentially an off mode. The "HOME" mode arms the security system to respond to conditions which may occur when the occupant of the premises is actually on the premises, such as medical emergency, silent or audible panic, but does not activate certain burglar alarm functions, such as infrared motion detectors, so that the occupants of the premises can move about freely without tripping the burglar alarms. The "AWAY" mode is used when there is no one physically on the premises. In the "AWAY" mode, all of the security system functions (fire, burglar, motion detection, etc.) are armed.

HVAC sensor 34 is armed in both the "HOME" and "AWAY" modes. HVAC sensor 32 is armed only in the "HOME" mode. "HOME" mode activation of sensor 32 is accomplished through a switch-to-ground circuit, described more fully hereinafter. Normally, some HVAC functions must be carried out even if the premises are unoccupied. For example, the premises must be kept heated in the winter time to prevent pipes from freezing.

Figure 3:
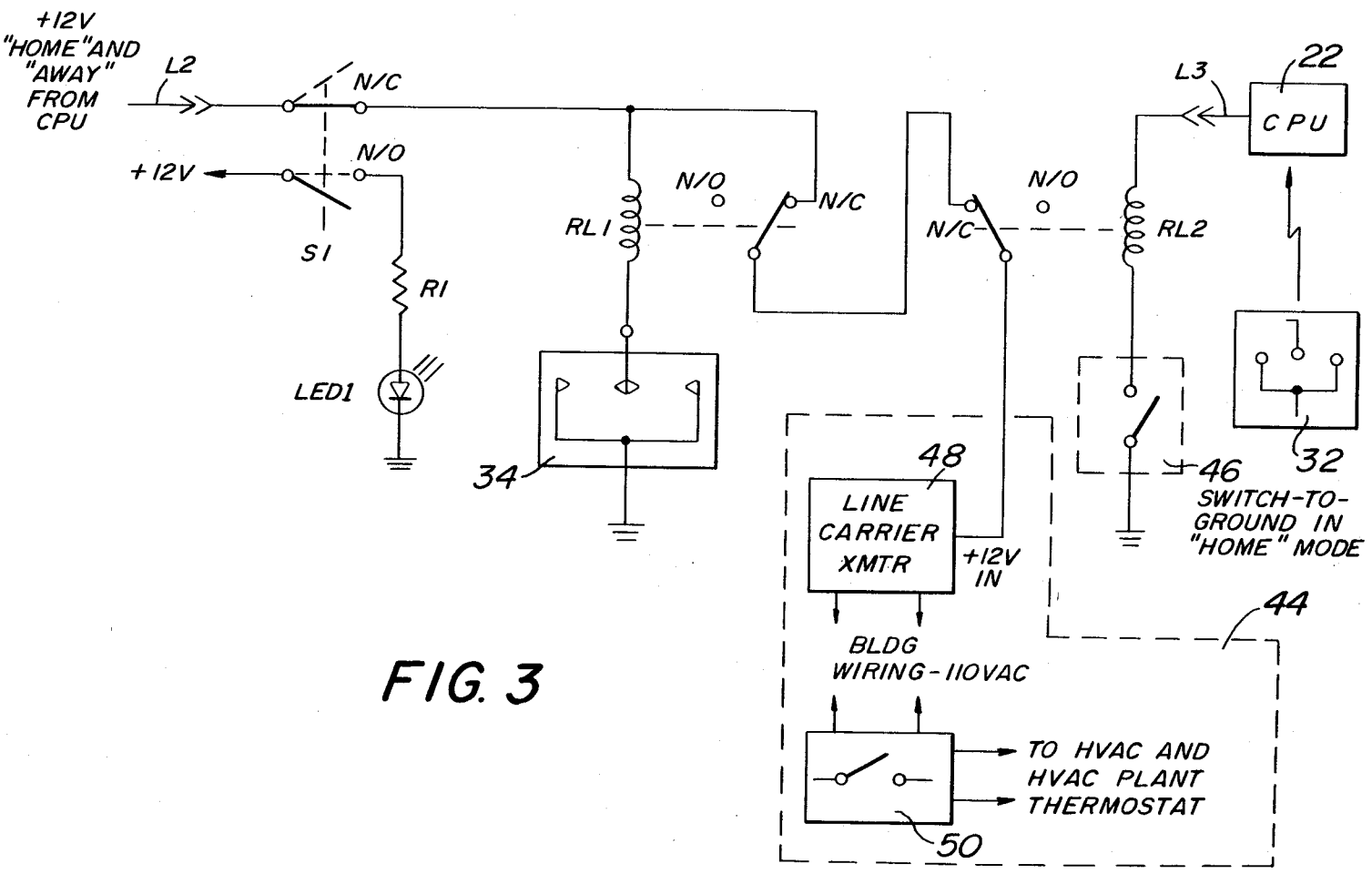
FIG. 3 is a simplified schematic diagram of the wireless security system in accordance with the present invention.

Referring now to FIG. 3, there is shown in simplified schematic form the interconnection among the ambient condition sensors 32 and 34, CPU 22 and HVAC control 44. At the upper left hand corner of FIG. 3 is shown a line L2. This line represents a +12 volt DC output found on typical wireless security systems. A voltage of +12 volt DC is applied to line L2 when the central control unit 10 is armed to either the "HOME" or "AWAY" mode. Line L2 is connected to one of a pair of normally-closed (N/C) terminals of ganged "defeat" switch S1. The other normally-closed terminal of switch S1 is connected to one side of the coil of relay RL1. Switch S1 also has a pair of normally-open (N/O) contacts one of which is connected to a constant +12 volt DC supply and the other of which is connected to light-emitting diode LED 1 through current-limiting resistor R1. Both pairs of switch contacts operate together, i.e., are "ganged". Switch S1 can thus be used to defeat the condition sensors 32 and 34 so that the HVAC operates independently of the wireless security system. When switch S1 is in the position shown in phantom in FIG. 3, sensors 32 and 34 are defeated, and LED 1 is illuminated to indicate that condition.

The opposite side of the coil of relay RL1 is connected to wired-in ambient condition sensor 34. Ambient condition sensor 34 may be a high/low limit electromechanical thermostat, such as are well-known in the art. In such a case, the coil of relay RL1 is connected to the pointer of the thermostat. The high and low limit arms of the thermostat are both connected to ground.

Relay RL1 has a pair of normally-closed (N/C) contacts wired in series with the normally closed contacts of switch S1 and the normally-closed contacts of relay RL2. The side of normally-closed contacts of relay RL2 opposite the normally-closed contacts of relay RL1 is connected to the +12 volt input of line carrier transmitter 48, which is connected to the premises AC wiring. Line carrier transmitter 48 will be described in greater detail herein below.

The coil of relay RL2 is connected between a line L3, which represents an output from CPU 22, and a switch 46 to ground. Switch 46 is open when the central control unit 10 is armed to the "AWAY" mode and closed when the central control unit is armed to the "HOME" mode. That is, the coil of relay RL2 can be energized only when the central control unit 10 is armed to the "HOME" mode. Line L3 provides a +12 volt DC level whenever CPU 22 receives an RF pulse from remote ambient condition sensor 32. Line L3 maintains the +12 volt DC level for a period of ten minutes as determined by a timer circuit (not shown) and then drops to zero volts. Any conventional timer circuit may be used to achieve the desired ten minute period. Of course, any other period of time may be chosen without departing from the invention.

Remote ambient condition sensor 32 may be a high/-low limit electromechanical thermostat like wired-in sensor 34, but with an associated RF transmitter which transmits an RF burst to the CPU 22 when either the high or low limit is reached. The manner in which such a remote ambient condition sensor can be constructed is believed to be well within the level of ordinary skill in the art, and need not be described in detail here.

Line carrier transmitter 48 may be a conventional line carrier transmitter with a built in 18 VAC, 20 VA transformer. When the line carrier transmitter 48 receives a +12 volt DC input, it generates an output signal which is transmitted over the premises AC wiring to a line carrier receiver 50. Line carrier receiver 50 contains a normally-closed switch which is held open as long as line carrier receiver 50 receives a signal from line carrier transmitter 50. If the +12 volt DC input to the line carrier transmitter is removed, the output of line carrier transmitter 48 is cut off, and this in turn removes the input signal from line carrier receive 50. This permits the normally-closed switch within line carrier receiver 50 to move to the closed position. The normally-closed switch within line carrier receiver 50 is connected in series with the premises HVAC and HVAC thermostat. Thus, when the normally-closed switch is in the open position, the premises HVAC is off, and when the normally-closed switch is in the closed position, the premises HVAC is on.

The manner in which the invention operates will now be described with reference to FIG. 3. As noted above, a 12 volt signal is applied to L2 whenever the central control unit 10 is in either the "HOME" or "AWAY" mode. Assuming first that the unit is armed for the "HOME" mode, switch 46 is closed, so that relay RL2 will be energized whenever line L3 has 12 volts applied to it by CPU 22 in response to an RF burst from remote ambient condition sensor 32.

Remote ambient condition sensor 32 thus functions as the primary ambient condition sensor. If ambient condition sensor 32 is a thermostat as described above, the temperature high/low limits may be set just as one sets any ordinary thermostat. When the ambient temperature reaches one of the limits, either high or low, the pointer closes a circuit in sensor 32 and the RF transmitter associated with the thermostat sends a single RF pulse over one of the RF channels to CPU 22. It is typical for remote RF sensors to transmit only a single RF pulse when triggered. When CPU 22 receives the RF pulse, it causes line L3 to go to +12 volt DC, and RL2 will be energized. When RL2 is energized, the normally-closed contacts of RL2 open, interrupting the 12 volt signal from line L2 to line carrier transmitter 48, thereby removing the 12 volt DC input to the line carrier transmitter, which in turn cuts of the output of the line carrier transmitter. The absence of an output from the line carrier transformer is sensed by the line carrier receiver 50, which turns the line carrier receiver off and allows the normally closed switch to close, thereby turning on the HVAC. The HVAC will then operate for ten minutes, the period during which line L3 is at +12 volts DC. It is believed that adequate HVAC control is obtained by periodic, rather than continuous, operation.

Assuming now that the central control unit 10 is armed to the "AWAY" mode, switch 46 will open. Thus, remote ambient condition sensor 32 will have no effect. Instead, ambient condition control is now performed by the wired-in ambient condition sensor 34. Ambient condition sensor 34 thus operates independently of sensor 32 in the "AWAY" mode. Assuming that ambient condition sensor 34 is a thermostat as described above, temperature limits may be set just as with sensor 32. The range of limits of sensor 34 may be greater than (i.e., higher and lower) or equal to the range of limits of sensor 32. When the pointer of sensor 34 hits a high or low temperature limit, it completes the circuit of the coil of relay RL1 to ground, causing the normally-closed contacts of RL1 to open. Since relay RL2 will not be energized in the "AWAY" mode, the normally-closed contacts of RL2 remain closed. When the normally-closed contacts of relay RL1 open in response to the thermostat reaching a high or low limit, the 12 volt DC from line L2 to line carrier transmitter 48 is interrupted, which, as described above, causes the normally-closed switch held open by line carrier receive 50 to close, completing the HVAC circuit and turning the HVAC on. The HVAC remains on as long as the temperature remains at the high or low limit.

It should be noted that by connecting the contacts of relays RL1 and RL2 in series, the wired-in ambient condition sensor 34 also functions as a back-up to the remote ambient condition sensor 32 whenever the central control unit is in the "HOME" mode. This is important because, in the "HOME" mode, L3 stays at the +12 volt DC level for only ten minutes. It is felt that this is sufficient to maintain adequate temperature control. That is, it is felt that the pointer will move off the high or low limit after ten minutes. However, typical RF remote sensors generate only a single RF pulse when they are triggered. In the case of the thermostat, when the pointer contacts one of high or low limits, only a single pulse is sent to the CPU. If the pointer remains on the contact, no further RF pulses are sent by the transmitter. Thus, if because of some problem the ten minute application of power to the HVAC is not enough to cause the pointer to move off of the contact, the HVAC will nonetheless shut off after ten minutes and stay off. Actual ambient temperature could therefore exceed the preset limits on sensor 32 and the HVAC would not be energized to correct the problem. However, by connecting the contacts of relays RL1 and RL2 in series, even if the temperature exceeds the preset limits on sensor 32, once the ambient temperature reaches one of the limits in wired-in ambient condition sensor 34, RL1 will be energized and open the normally-closed contacts of RL1, which in turn completes the circuit for the HVAC thermostat as described above. Thus, wired-in ambient condition sensor 34 acts as a secondary, or back-up, sensor for remote ambient condition sensor 32.

Of course, it will be recognized that, following the teachings of the invention, any condition-responsive sensor can be provided with a back-up for "fail safe" operation, regardless of the condition being monitored. In addition, any number of sensors may be backed-up as desired.

The present invention thus provides expanded control capacity without adding to the number of RF channels, and enables back-up or "fail safe" operation of the security system.

The present invention may be embodied in other specific forms without departing from the spirit or essential attributes thereof and, accordingly, reference should be made to the appended claims, rather than to the foregoing specification, as indicating the scope of the invention.

I claim:

1. A wireless security system comprising:

(a) a central processing unit;

(b) at least one primary condition-responsive monitoring device for wireless communication with the central processing unit, the primary condition-responsive monitoring device being arranged to monitor and respond to a parameter representative of a condition being monitored over a first range of values of the parameter and to communicate with the central processing unit when the parameter falls outside the first range;

(c) at least one secondary condition-responsive monitoring device for wired communication with the central processing unit, the secondary condition-responsive monitoring device being arranged to be selectively switched into and out of electrical series connection with the primary condition-responsive monitoring device and arranged to monitor and respond to the same parameter representative of the condition being monitored over a second range of values of the parameter and to communicate with the central processing unit when the parameter falls outside the second range, the second range of values being greater than or equal to the first range of values; and (d) switch means for selectively switching the secondary condition-responsive monitoring device into and out of electrical series connection with the primary condition-responsive monitoring device.

2. A wireless security system according to claim 1, wherein the central processing unit is a microprocessor.

3. A wireless security system according to claim 1, wherein the primary and secondary condition-responsive monitoring devices each comprise a thermostat.

4. Apparatus for controlling ambient temperature in a building comprising:

(a) a central processing unit;

(b) at least one primary temperature-responsive monitoring device for wireless communication with the central processing unit, the primary temperature-responsive monitoring device being arranged to monitor and respond to ambient temperature over a first range of temperature values and to communicate with the central processing unit when the temperature falls outside the first range;

(c) a secondary temperature-responsive monitoring device for wired communication with the central processing unit, the secondary temperature-responsive monitoring device being arranged to be selectively switched into and out of electrical series connection with the primary temperature-responsive monitoring device and arranged to monitor and respond to ambient temperature over a second range of temperature values and to communicate with the central processing unit when the temperature falls outside the second range, the second range of values being greater than the first range of values; and (d) switching means for selectively switching the secondary temperature-responsive monitoring device into and out of electrical series connection with the primary temperature-responsive monitoring device.

5. Apparatus according to claim 4, wherein the central processing unit is a microprocessor.

6. Apparatus according to claim 4, wherein the primary and secondary temperature-responsive monitoring devices each comprise a thermostat.

* * * * *